US010786917B1

(12) United States Patent
Walton

(10) Patent No.: US 10,786,917 B1
(45) Date of Patent: Sep. 29, 2020

(54) HANDHELD RAZOR CUTTER APPARATUS

(71) Applicant: Cam Michael Walton, Dover, FL (US)

(72) Inventor: Cam Michael Walton, Dover, FL (US)

( * ) Notice: Subject to any disclaimer, the term of this patent is extended or adjusted under 35 U.S.C. 154(b) by 0 days.

(21) Appl. No.: 16/367,704

(22) Filed: Mar. 28, 2019

(51) Int. Cl.

| | |
|---|---|
| ***B26B 21/52*** | (2006.01) |
| ***B26B 5/00*** | (2006.01) |
| ***B26B 21/40*** | (2006.01) |
| *B26B 29/02* | (2006.01) |

(52) U.S. Cl.
CPC ..... *B26B 21/521* (2013.01); *B26B 5/003* (2013.01); *B26B 21/4012* (2013.01); *B26B 29/02* (2013.01)

(58) Field of Classification Search
CPC ... B26B 21/521; B26B 21/4012; B26B 5/003; B26B 29/02
USPC ..... 30/286, 287, 294, 526, 529
See application file for complete search history.

(56) References Cited

U.S. PATENT DOCUMENTS

| | | | | |
|---|---|---|---|---|
| 1,247,266 | A * | 11/1917 | Hartman | B26B 21/18 30/70 |
| 1,450,604 | A * | 4/1923 | Mossberg | B26B 21/52 30/529 |
| 1,455,726 | A * | 5/1923 | Hartman | B26B 21/52 30/66 |
| 2,008,681 | A * | 7/1935 | Carlson | B26B 21/32 30/60 |
| 4,910,821 | A * | 3/1990 | Kieferle | B26B 5/001 29/235 |
| 6,473,974 | B1 * | 11/2002 | Ireland | B26B 3/00 30/279.6 |
| 7,305,729 | B2 * | 12/2007 | Dehner | B26B 5/003 30/162 |
| 7,533,595 | B2 | 5/2009 | Domenico | |
| 7,694,422 | B2 * | 4/2010 | Vaes | B25F 1/00 30/162 |
| D660,675 | S | 5/2012 | Gringer | |
| 9,840,013 | B2 | 12/2017 | Garavaglia | |
| 2007/0234484 | A1 * | 10/2007 | Guffey | B26B 11/00 7/158 |
| 2009/0158529 | A1 * | 6/2009 | Vaes | B26B 11/00 7/158 |

FOREIGN PATENT DOCUMENTS

| | | |
|---|---|---|
| WO | WO2008058038 | 5/2008 |

* cited by examiner

*Primary Examiner* — Hwei-Siu C Payer

(57) ABSTRACT

A handheld razor cutter apparatus for cutting and trimming materials such as screens includes a blade housing coupled to a handle. The handle is coupled to a top plate of the blade housing such that it secures the blade housing in a horizontal position. A bottom plate is selectively engageable with a bottom side of the top plate to secure a razor blade therebetween. The razor blade has an edge encompassed by the perimeter of the bottom plate. The blade housing has a plurality of notches extending through the perimeter. The edge of the razor blade is sharpened on at least a plurality of exposed portions defined by the plurality of notches of the blade housing to perform cuts.

17 Claims, 4 Drawing Sheets

HANDHELD RAZOR CUTTER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to cutters and more particularly pertains to a new cutter for cutting and trimming materials such as screens.

BRIEF SUMMARY OF THE INVENTION

An embodiment of the disclosure meets the needs presented above by generally comprising a handle having a proximal end and a distal end and a blade housing coupled to the distal end. The blade housing comprises a top plate and a bottom plate each having a corresponding plurality of notches extending through the respective perimeters thereof. The handle is coupled to a top side of the top plate such that it secures the blade housing in a horizontal position with the handle extending at an upward angle before bending to lie in a plane substantially parallel to a plane of the blade housing. The bottom plate is selectively engageable with a bottom side of the top plate to secure a razor blade therebetween. The perimeter of the bottom plate either aligns with, or is encompassed by, the perimeter of the top plate. The razor blade has an edge encompassed by the perimeter of the bottom plate. The edge of the razor blade is sharpened on at least a plurality of exposed portions defined by the plurality of notches of the blade housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
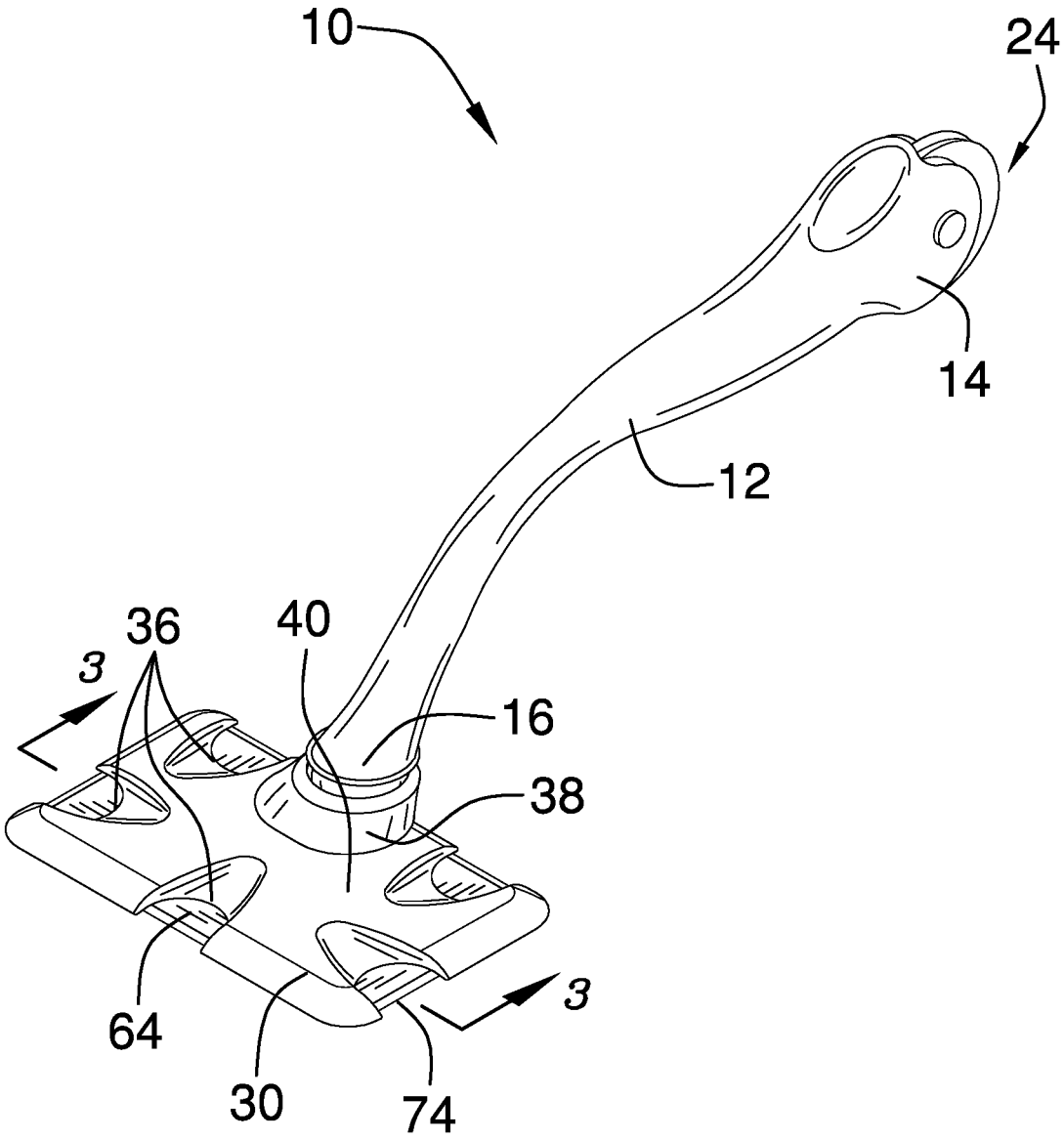
FIG. 1 is an isometric view of a handheld razor cutter apparatus according to an embodiment of the disclosure.
Figure 2:
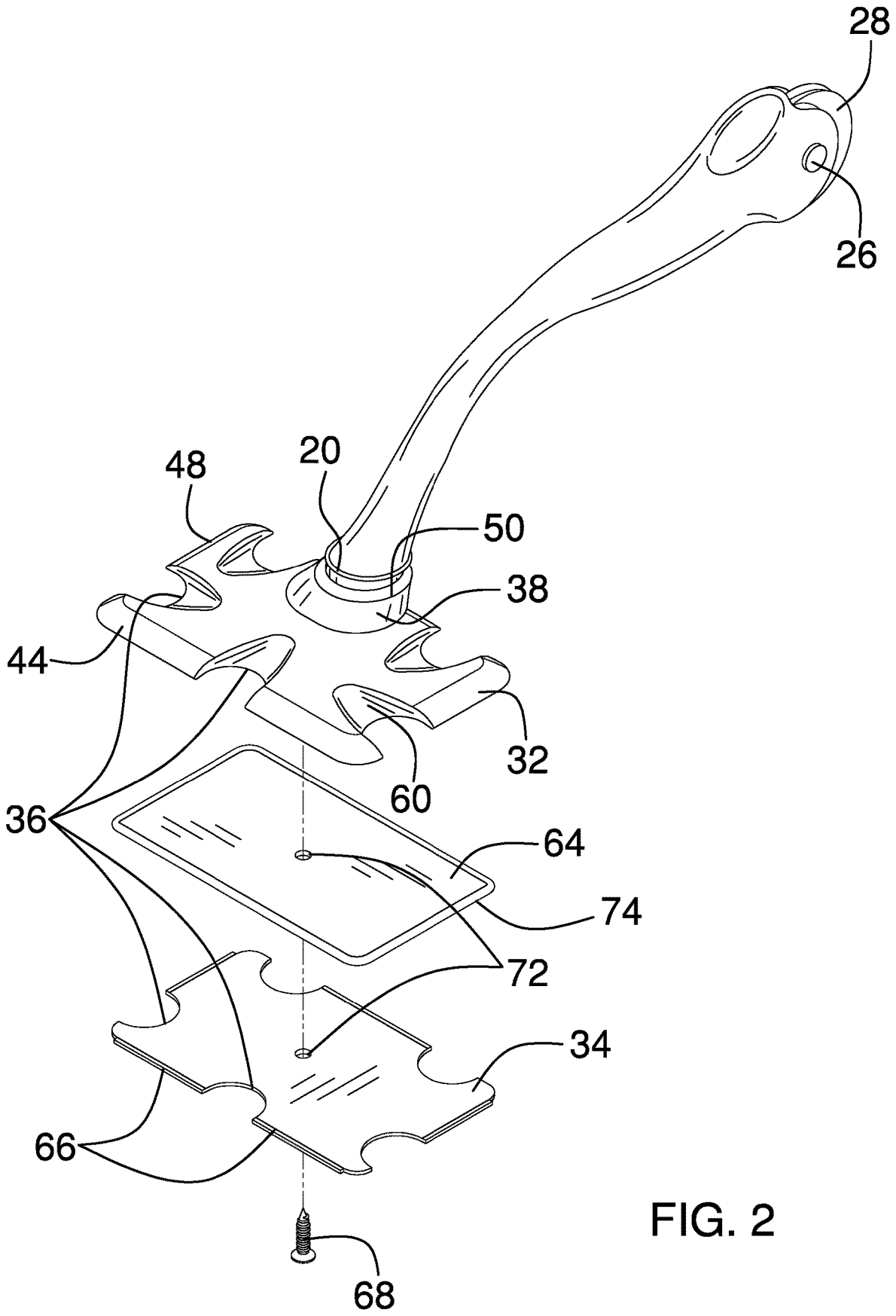
FIG. 2 is an isometric exploded view of an embodiment of the disclosure.
Figure 3:
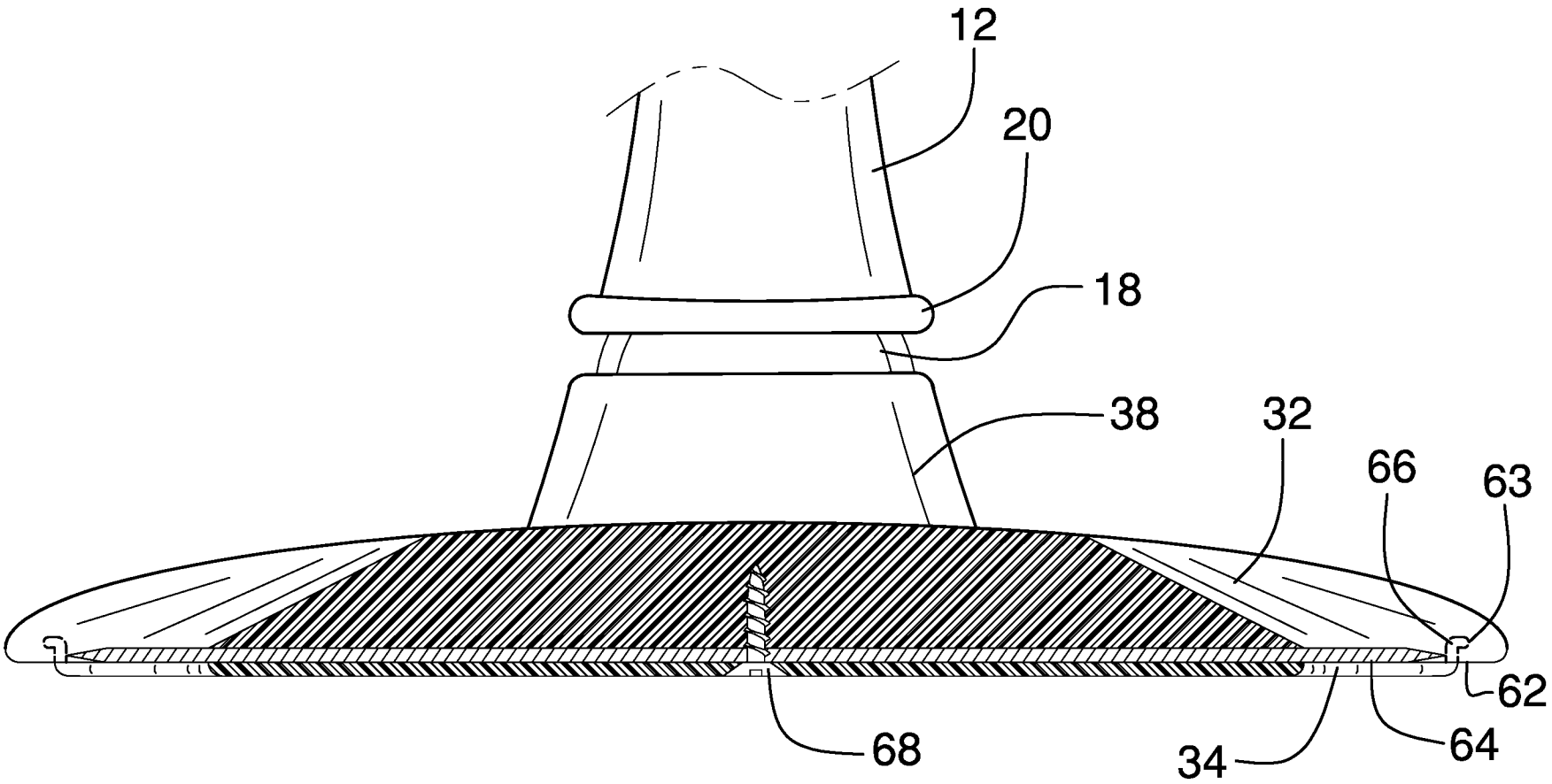
FIG. 3 is a cross-sectional view of an embodiment of the disclosure along line 3-3 of FIG. 1.
Figure 4:
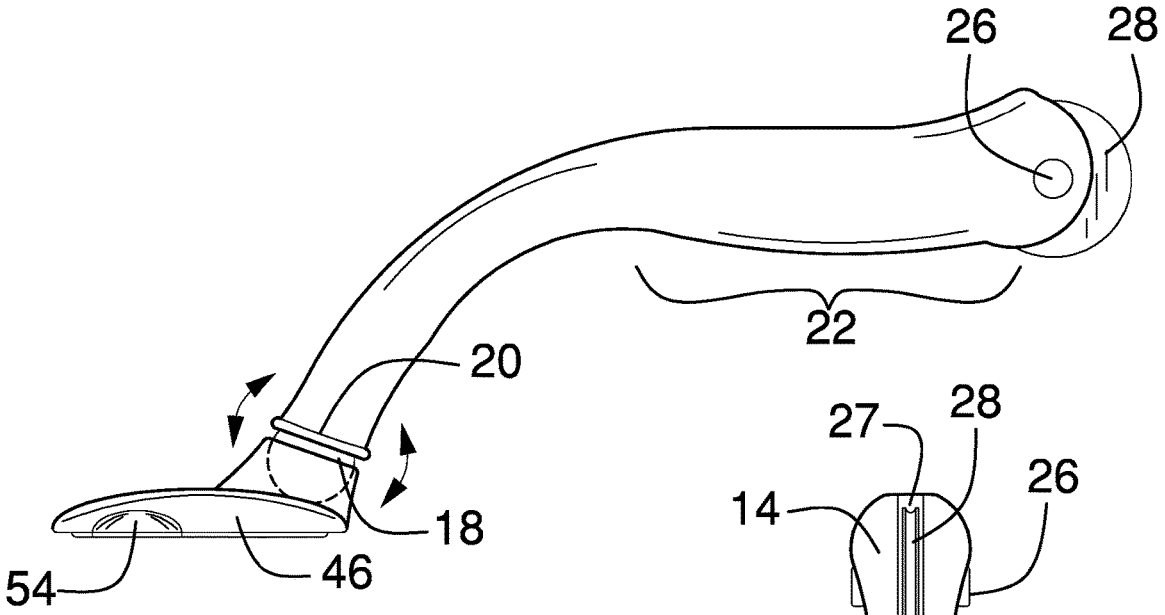
FIG. 4 is a side elevation view of an embodiment of the disclosure.
Figure 5:
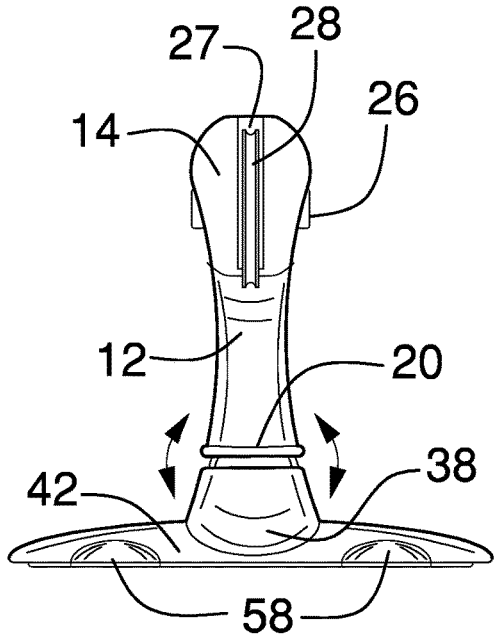
FIG. 5 is a rear elevation view of an embodiment of the disclosure.
Figure 6:
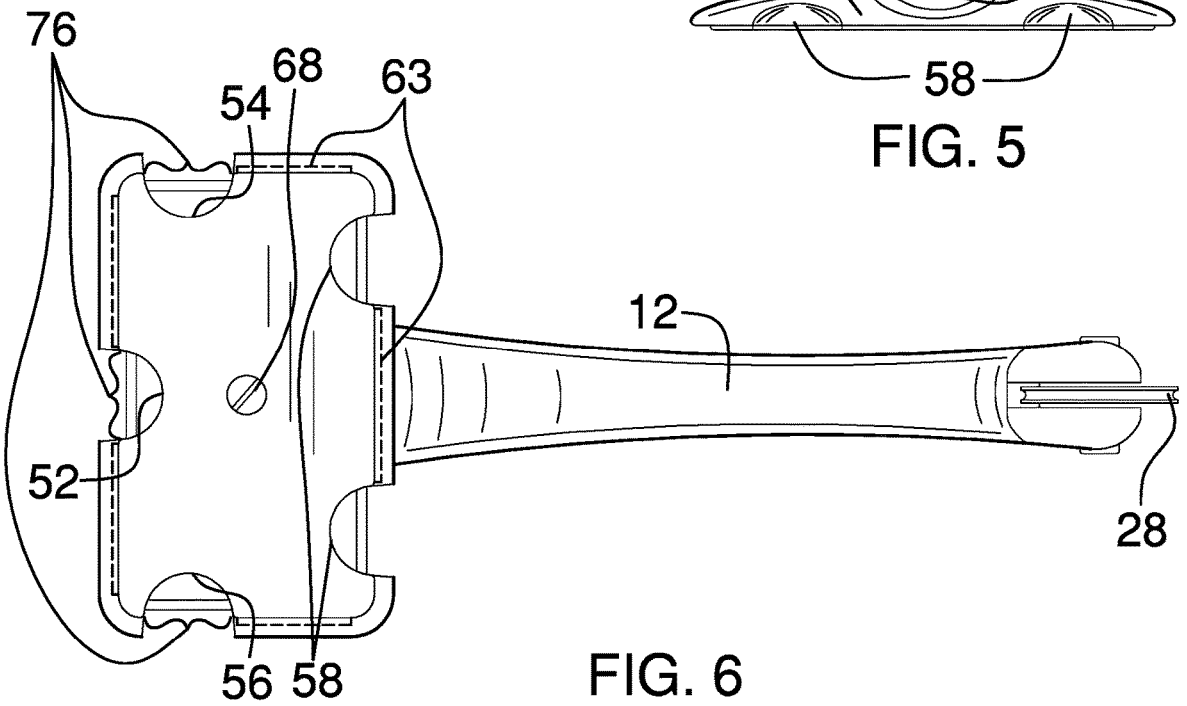
FIG. 6 is a bottom plan view of an embodiment of the disclosure.

With reference now to the drawings, and in particular to FIGS. 1 through 6 thereof, a new cutter embodying the principles and concepts of an embodiment of the disclosure and generally designated by the reference numeral 10 will be described.

As best illustrated in FIGS. 1 through 6, the handheld razor cutter apparatus 10 generally comprises a handle 12 having a proximal end 14 and a distal end 16. The distal end 16 may comprise a truncated sphere 18 and a collar 20. The handle 12 may taper thinner from the collar 20 and then taper wider through a horizontal portion 22 to create an ergonomic grip. A spline roller 24 is coupled to the handle 12 and comprises an axle 26 rotatably coupled through a vertical wheel channel 27 extending through the proximal end 14 of the handle 12 and a wheel 28 coupled to the axle 26. The perimeter of the wheel 28 may be either concave or convex and is configured to apply spline when installing screens on a door or window frame.

A blade housing 30 is coupled to the distal end 16 of the handle. The blade housing 30 comprises a top plate 32 and a bottom plate 34 each having a corresponding plurality of notches 36 extending through the respective perimeters thereof. The perimeter of the top plate 32, the perimeter of the bottom plate 34, and the corners of the blade housing 30 are rounded to allow the blade housing 30 to slide over any contact surface, including a frame, a spline channel, a spline, and a new screen panel, without catching or scratching. The top plate 32 has a handle receptacle 38 extending from a top side 40 adjacent a rear side 42. The handle receptacle 38 is a rounded cup shape making the truncated sphere 18 pivotably engageable within the handle receptacle 38 with the collar 20 limiting the range of motion of the handle 12. The blade housing 30 is secured in a horizontal position and is pivotable along a front-rear axis perpendicularly oriented between a front side 44 and the rear side 42 and a left-right axis perpendicularly oriented between a left side 46 and a right side 48, but not rotatable relative the handle 12. The handle 12 extends at an upward angle before bending to lie in a plane substantially parallel to a plane of the blade housing 30. A top rim 50 of the handle receptacle lies in a plane forming an angle with a plane of the bottom plate 34 between parallel and 45° to allow a user to comfortably grip the horizontal portion 22 of the handle and push the blade housing 30 horizontally without unintentionally pivoting the handle 12.

The plurality of notches 36 comprises a front notch 52 medially extending through the front side 44 of the blade housing, a left notch 54 and a right notch 56 extending through the left side 46 and the right side 48 of the blade housing, respectively, and at least one rear notch 58 extending through the rear side 42 of the blade housing. The at least one rear notch 58 either extends between the handle 12 and the left side 46, between the handle 12 and the right side 48, or both between the handle 12 and the left side 46 and between the handle 12 and the right side 48. Each of the plurality of notches 36 may be semi-circular and may have a tapered profile 60 to prevent binding of materials during removal and to allow a channel to form in the material directly after the cutting procedure while in motion both during the removal of excess material with the front notch 52, the left notch 54, or the right notch 56, and during the removal of excess material spline with the rear notch 58.

The bottom plate 34 is selectively engageable with a bottom side 62 of the top plate to secure a razor blade 64 therebetween. The perimeter of the bottom plate 34 either aligns with, or is encompassed by, the perimeter of the top plate 32. The bottom side 62 of the top plate may have a plurality of tab channels 63 corresponding to a plurality of tabs 66 extending from the perimeter of the bottom plate 34. The plurality of tabs 66 is selectively engageable within the plurality of tab channels 63 to secure the bottom plate 34 to the top plate 32. At least one fastener 68 may be used to further secure the bottom plate 34. The at least one fastener 68 is selectively engageable with a fastener aperture 70 within the bottom side 62 of the top plate. The at least one fastener 68 extends through at least one through hole 72 extending through each of the bottom plate 34 and the razor blade 64 to secure the bottom plate 34 to the top plate 32 and the razor blade 64 therebetween. The bottom plate 34 is thus removable allowing the razor blade 64 to be rotated or replaced. The bottom plate 34 may alternatively be permanently fixed to the top plate 32 to decrease cost of manufacturing and to create a disposable version of the apparatus 10.

The razor blade 64 has an edge 74 encompassed by the perimeter of the bottom plate 34. The edge 74 of the razor blade may be sharpened on at least a plurality of exposed portions 76 defined by the plurality of notches 36 of the blade housing. The edge 74 has either a V-shaped profile or a chisel-shaped profile angling towards the bottom plate 34. The chisel-shaped profile brings the cutting action to be as close as possible to the bottom plate 34 and thus to the frame or surface from which the material is being cut. The width and the length of the bottom plate 34 are larger than the width and the length of the razor blade 64, respectively, by no less than twice the thickness of the bottom plate 34. The thickness of the bottom plate 34 is ideally less than 0.3 mm.

In use, the handle 12 is secured and used to slide the blade housing 30 while cutting screen from a frame with the screen being cut within one of the plurality of notches 36. When installing a replacement screen the spline roller 24 is used to install the spline securing the screen.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A handheld razor cutter apparatus comprising:

a handle having a proximal end and a distal end;

a blade housing coupled to the distal end of the handle, the blade housing comprising a top plate and a bottom plate each having a corresponding plurality of notches extending through the respective perimeters thereof, the handle being coupled to a top side of the top plate such that it secures the blade housing in a horizontal position, the handle extending at an upward angle before bending to lie in a plane parallel to a plane of the blade housing;

the bottom plate being selectively engageable with a bottom side of the top plate to secure a razor blade therebetween, the perimeter of the bottom plate either aligning with, or being encompassed by, the perimeter of the top plate; and the razor blade having an edge encompassed by the perimeter of the bottom plate, the edge of the razor blade being sharpened on at least a plurality of exposed portions defined by the plurality of notches of the blade housing.

2. The handheld razor cutter apparatus of claim 1 wherein the plurality of notches comprises a front notch medially extending through a front side of the blade housing, a left notch and a right notch extending through a left side and a right side of the blade housing, respectively, and at least one rear notch extending through a rear side of the blade housing, the at least one rear notch extending between the handle and the left side, between the handle and the right side, or both between the handle and the left side and between the handle and the right side.

3. The handheld razor cutter apparatus of claim 1 further comprising the top plate of the blade housing having a handle receptacle extending from the top side adjacent a rear side of the top plate, the handle receptacle receiving the distal end of the handle such that the blade housing is pivotable along a front-rear axis perpendicularly oriented between a front side and a rear side of the blade housing and a left-right axis perpendicularly oriented between a left side and a right side of the blade housing, but not rotatable relative the handle.

4. The handheld razor cutter apparatus of claim 3 wherein the handle receptacle is a rounded cup shape and the distal end of the handle is a truncated sphere and a collar, the truncated sphere being pivotably engageable within the handle receptacle and the collar limiting the range of motion of the handle.

5. The handheld razor cutter apparatus of claim 3 wherein a top rim of the handle receptacle lies in a plane forming an angle with a plane of the bottom plate between parallel and 45°.

6. The handheld razor cutter apparatus of claim 1 wherein respective corners of the perimeter of the top plate, of the perimeter of the bottom plate, and of the blade housing are rounded.

7. The handheld razor cutter apparatus of claim 1 further comprising at least one fastener being selectively engageable with a fastener aperture within the bottom side of the top plate, the at least one fastener extending through at least one through hole extending through each of the bottom plate and the razor blade to secure the bottom plate to the top plate and with the razor blade disposed therebetween.

8. The handheld razor cutter apparatus of claim 1 wherein the bottom side of the top plate has a plurality of tab channels corresponding to a plurality of tabs extending from the perimeter of the bottom plate, the plurality of tabs being selectively engageable within the plurality of tab channels to secure the bottom plate to the top plate.

9. The handheld razor cutter apparatus of claim 1 wherein each of the plurality of notches is semi-circular.

10. The handheld razor cutter apparatus of claim 1 wherein each of the plurality of notches has a tapered profile tapering towards the edge of the razor blade.

11. The handheld razor cutter apparatus of claim 1 wherein the width and the length of the bottom plate are larger than the width and the length of the razor blade, respectively, by no less than twice the thickness of the bottom plate.

12. The handheld razor cutter apparatus of claim 1 wherein the edge of the razor blade has a V-shaped profile.

13. The handheld razor cutter apparatus of claim 1 wherein the edge of the razor blade has a chisel shaped profile angling towards the bottom plate.

14. The handheld razor cutter apparatus of claim 1 wherein the handle tapers thinner at the distal end and wider through a horizontal portion of the handle to create an ergonomic grip.

15. The handheld razor cutter apparatus of claim 1 further comprising a spline roller coupled to the handle, the spline roller comprising an axle rotatably coupled through a vertical wheel channel extending through the proximal end of the handle and a wheel coupled to the axle.

16. The handheld razor cutter apparatus of claim 15 further comprising the perimeter of the wheel being either concave or convex.

17. A handheld razor cutter apparatus comprising:

a handle having a proximal end and a distal end, the distal end comprising a truncated sphere and a collar, the handle tapering thinner at the collar and wider through a horizontal portion of the handle to create an ergonomic grip;

a spline roller coupled to the handle, the spline roller comprising an axle rotatably coupled through a vertical wheel channel extending through the proximal end of the handle and a wheel coupled to the axle, the perimeter of the wheel being either concave or convex;

a blade housing coupled to the distal end of the handle, the blade housing comprising a top plate and a bottom plate each having a corresponding plurality of notches extending through the respective perimeters thereof, respective corners of the perimeter of the top plate, of the perimeter of the bottom plate, and of the blade housing being rounded, the top plate having a handle receptacle extending from a top side of the top plate adjacent a rear side of the top plate, a top rim of the handle receptacle lying in a plane forming an angle with a plane of the bottom plate between parallel and 45°;

the handle receptacle being a rounded cup shape, the truncated sphere being pivotably engageable within the handle receptacle and the collar limiting the range of motion of the handle such that the blade housing is secured in a horizontal position and is pivotable along a front-rear axis perpendicularly oriented between a front side of the top plate and the rear side of the top plate and a left-right axis perpendicularly oriented between a left side of the blade housing and a right side of the blade housing, but not rotatable relative the handle, the handle extending at an upward angle before bending to lie in a plane parallel to a plane of the blade housing;

the plurality of notches comprising a front notch medially extending through the front side of the top plate, a left notch and a right notch extending through the left side and the right side of the blade housing, respectively, and at least one rear notch extending through the rear side of the top plate, the at least one rear notch either extending between the handle and the left side of the blade housing, between the handle and the right side of the blade housing, or both between the handle and the left side of the blade housing and between the handle and the right side of the blade housing, each of the plurality of notches being semi-circular and having a tapered profile;

the bottom plate being selectively engageable with a bottom side of the top plate to secure a razor blade therebetween, the perimeter of the bottom plate either aligning with, or being encompassed by, the perimeter of the top plate, the bottom side of the top plate having a plurality of tab channels corresponding to a plurality of tabs extending from the perimeter of the bottom plate, the plurality of tabs being selectively engageable within the plurality of tab channels to secure the bottom plate to the top plate;

the razor blade having an edge encompassed by the perimeter of the bottom plate, the edge of the razor blade being sharpened on at least a plurality of exposed portions defined by the plurality of notches of the blade housing, the edge having either a V-shaped profile or a chisel-shaped profile angling towards the bottom plate;

wherein the width and the length of the bottom plate are larger than the width and the length of the razor blade, respectively, by no less than twice the thickness of the bottom plate; and at least one fastener, the at least one fastener being selectively engageable with a fastener aperture within the bottom side of the top plate, the at least one fastener extending through at least one through hole extending through each of the bottom plate and the razor blade to secure the bottom plate to the top plate and with the razor blade disposed therebetween.

* * * * *